US006329653B1

(12) United States Patent
Syage et al.

(10) Patent No.: US 6,329,653 B1
(45) Date of Patent: Dec. 11, 2001

(54) PHOTOIONIZATION MASS SPECTROMETER

(75) Inventors: Jack A. Syage, Huntington Beach; Karl A. Hanold, Irvine; Mark A. Hanning-Lee, Tustin, all of CA (US)

(73) Assignee: Syagen Technology, Tustin, CA (US)

( * ) Notice: Subject to any disclaimer, the term of this patent is extended or adjusted under 35 U.S.C. 154(b) by 0 days.

(21) Appl. No.: 09/653,038

(22) Filed: Sep. 1, 2000

Related U.S. Application Data

(63) Continuation of application No. 09/247,646, filed on Feb. 9, 1999, now Pat. No. 6,211,516.

(51) Int. Cl.[7] ..... H01J 49/04
(52) U.S. Cl. ..... 250/282; 250/288
(58) Field of Search ..... 250/288, 282; 436/173

(56) References Cited

U.S. PATENT DOCUMENTS

| | | | | |
|---|---|---|---|---|
| 3,555,272 | * | 1/1971 | Munson et al. | 250/424 |
| 5,032,721 | * | 7/1991 | Bacon et al. | 250/288 |
| 5,234,838 | * | 8/1993 | Bacon, Jr. | 250/288 |
| 5,294,797 | * | 3/1994 | Frey et al. | 250/287 |

* cited by examiner

*Primary Examiner*—Jack Berman
(74) *Attorney, Agent, or Firm*—Irell & Manella, LLP.

(57) ABSTRACT

A monitor that can detect at least one trace molecule in a gas sample. The monitor may include a photoionizer that is coupled to an electron-ionization mass spectrometer. The photoionizer may ionize the gas sample at a wavelength(es) which ionizes the trace molecules without creating fragmentation. The inclusion of the electron-ionizer may allow alternate or additional ionization to detect trace molecules not ionized by the photoionizer. The gas sample may be ionized at atmospheric pressure which increases the yield of the ionized trace molecules and the sensitivity of the mass spectrometer.

10 Claims, 7 Drawing Sheets

PHOTOIONIZATION MASS SPECTROMETER

This application is a continuation of application Ser. No. 09/247,646, filed on Feb. 9, 1999, now U.S. Pat. No. 6,211,516.

BACKGROUND OF THE INVENTION

1. Field of the Invention

The present invention relates to mass spectrometry.

2. Background Information

Mass spectrometers can be used to determine the existence of trace molecules in a gas sample. FIG. 1 shows a quadrupole mass spectrometer which contains an electron-ionizer 1. The electron-ionizer 1 includes a filament 2 that extends around an anode grid cage 3. A gas sample is introduced into an ionization chamber 4 of the ionizer 1. The filament 2 bombards the gas sample with electrons to ionize molecules within the sample.

The spectrometer also includes a mass analyzer 5 which can determine the mass of the ionized molecules. The anode grid cage 3 is typically provided with a positive voltage potential to accelerate the ionized molecules into the mass analyzer 5. The mass analyzer 5 may contain an entrance plate 6 which has a negative voltage potential and two pairs of quadrupole rods 7 that are at an average potential near ground to pull the ionized molecules into the analyzer 5. The electron-ionizer 1 may also have a repeller cage 8 to contain the ionized molecules within the ionization chamber 4. The mass analyzer 5 provides output signals that are a function of the mass of the molecules detected by the analyzer.

It has been found that electron-ionization may create fragmentation which increases the number of different ions that are detected by the analyzer. The greater number of different ions formed increases the number of output signals detected by the analyzer. The additional output signals may result in erroneous conclusions regarding the content of the gas sample, particularly if there are two or more ionized molecules with approximately the same weight.

U.S. Pat. No. 5,808,299 issued to Syage discloses a mass spectrometer which contains a photoionizer. The photoionizer includes a light source which directs a light beam into a gas sample. The light beam contains energy which is high enough to ionize the trace molecules but below the energy level which typically causes fragmentation. Photoionization can therefore provide more reliable data from the mass spectrometer. It would be desirable to have an electron-ionization mass spectrometer that can photoionize a gas sample. It would also be desirable to modify an existing electron-ionization mass spectrometer to include a photoionizer.

There are also mass spectrometers which utilize chemical ionization wherein an electron or a proton is attached to the trace molecules. Chemical ionization may be achieved at "atmospheric" pressure. Atmospheric ionization pressure being a pressure level that is higher than the vacuum pressure of the mass detector of the spectrometer. Higher ionization pressure levels increases the density of the gas sample. The higher gas sample density increases the number of ionized trace molecules and the sensitivity of the mass spectrometer.

Chemical ionization can be effective when detecting trace molecules which have high electron or proton affinity. The detection of molecules that do not have a strong electron or proton affinity can be compromised when other molecules are present which do have a high affinity. For example, water is an abundant molecule which has a high proton affinity which competes for positive charges. Even if sufficient charge exists in the ionization source to ionize weakly interacting low abundance molecules, the presence of a strong protonated water $H_3O^+$ signal can overwhelm the detection of very weak signals from trace molecules of interest. Likewise for negative ion detection by electron attachment, oxygen molecules compete with trace molecules for electrons thereby reducing the number of ionized trace molecules and the sensitivity of the mass spectrometer. It would be desirable to provide an ionizer which ionizes a gas sample at atmospheric pressure but does not have the unfavorable characteristics of chemical ionization.

SUMMARY OF THE INVENTION

One embodiment of the present invention is a monitor that can detect at least one trace molecule in a gas sample. The monitor includes a photoionizer which can ionize the trace molecule, a detector that can detect the ionized trace molecule and an electron-ionizer that is coupled to the photoionizer and the detector.

DETAILED DESCRIPTION

Figure 2:
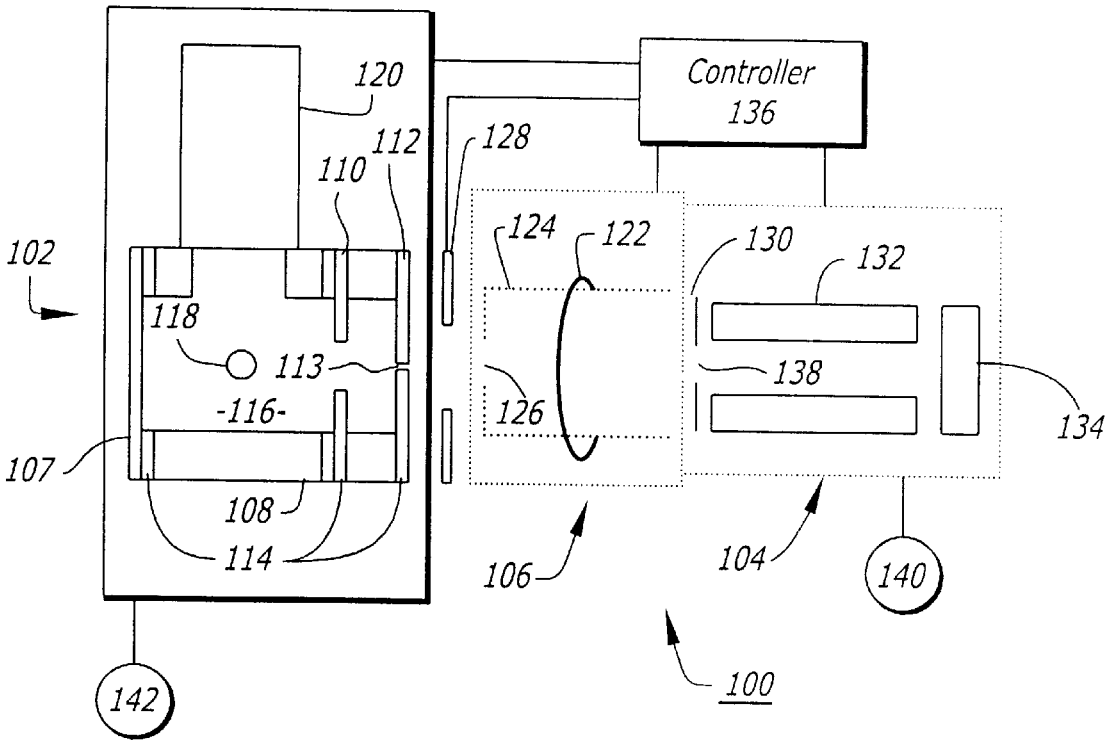
FIG. 2 is a schematic of an embodiment of a mass spectrometer of the present invention.

Referring to the drawings more particularly by reference numbers, FIG. 2 shows an embodiment of a mass spectrometer 100 of the present invention. The mass spectrometer 100 may include a photoionizer 102 that can ionize one or more trace molecules and a detector 104 that can detect the ionized trace molecules. The mass spectrometer 100 may also have an electron-ionizer 106 that is coupled to the photoionizer 102 and the detector 104. The electron-ionizer 106 may also ionize trace molecules. The mass spectrometer 100 of the present invention thus provides the opportunity to either photoionize the trace molecules or electron-ionize the trace molecules. Alternatively, the mass spectrometer 100 can be utilized to both photoionize and electron-ionize the trace molecules.

The photoionizer 102 may include a first electrode 107, a second electrode 108, a third electrode 110 and a fourth electrode 112 that direct ionized molecules through an aperture 113 in the fourth electrode 112. The electrodes 107, 108, 110 and 112 may be separated by electrical insulators 114. A gas sample may be introduced into an ionization chamber 116 of the photoionizer 102 through a sample valve 118. The sample valve 118 may be either of the pulsed or continuous type which allows sample gas from an outside source such as the ambient to flow into the ionization chamber 116.

The gas sample within the ionization chamber 116 can be ionized by a light beam emitted from a light source 120. The light beam may have a wavelength so that photo-energy between 8.0 and 12.0 electron volts (eV) is delivered to the gas sample. Photo-energy between 8.0 and 12.0 is high enough to ionize most trace molecules of interest without creating much molecular fragmentation within the sample. By way of example the light source 120 may be a Nd:YAG laser which emits light at a wavelength of 355 nanometers (nm). The 355 nm light may travel through a frequency tripling cell that generates light at 118 nms. 118 nm light has an energy of 10.5 eV. Such a light source 120 is described in U.S. Pat. No. 5,808,299 issued to Syage, which is hereby incorporated by reference. Alternatively, the light source may include continuous or pulsed discharge lamps which are disclosed in U.S. Pat. No. 3,933,432 issued to Driscoll; U.S. Pat. No. 5,393,979 issued to Hsi; U.S. Pat. No. 5,338,931 issued to Spangler et al. and U.S. Pat. No. 5,206,594 issued to Zipf, which are hereby incorporated by reference.

Figure 1:
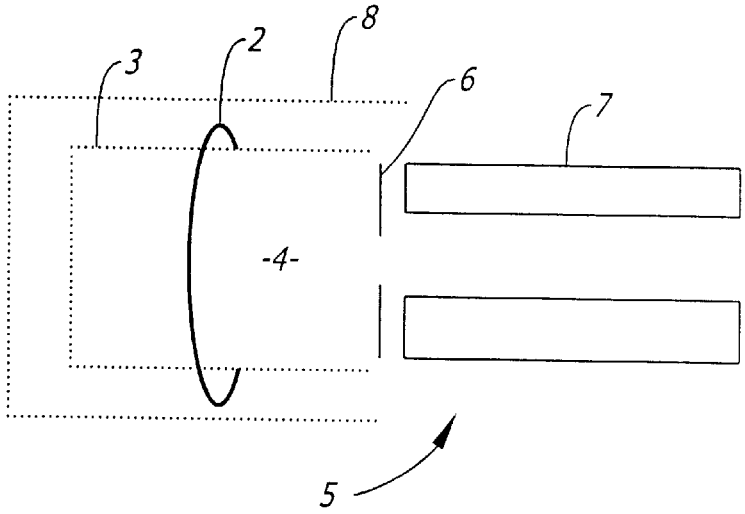
FIG. 1 (Prior Art)
FIG. 1 is a schematic of an embodiment of a mass spectrometer of the prior art.

The electron-ionizer 106 may include a filament 122 that extends around an anode grid cage 124. A voltage potential can be applied to the filament 122 to electron-ionize molecules within the anode grid cage 124. Although it is contemplated that the photoionizer 102 and the electron-ionizer 106 can be constructed as original equipment, it is to be understood that the present invention also allows an existing electron-ionization mass spectrometer to be modified to include a photoionizer. Referring to both FIGS. 1 and 2, an existing electron-ionizer can be modified by removing the repeller cage (reference numeral 8 in FIG. 1) and forming an opening (reference numeral 126 in FIG. 2) in the anode grid cage 124. As an alternate embodiment, the repeller cage 8 may remain in the electron-ionizer 106. As yet another embodiment the photoionizer 102 can be coupled to the electron-ionizer 106 without forming an opening in the anode grid cage 124.

The mass spectrometer 100 may further have a fourth electrode 128 located between the photoionizer 102 and the electron-ionizer 106. The fourth electrode 128 may collimate the flow of ionized trace molecules from the photoionizer 102 to the electron-ionizer 106.

The detector 104 may be a mass analyzer which has an entrance plate 130, two pairs of quadrupole rods 132 and a detector plate 134. The detector 104, photoionizer 102 and electron-ionizer 106 may all be connected to a controller 136 which controls the ionization of the gas sample, controls the voltages of the electrodes 107, 108, 110, 112 and 128, cage 124 and plate 130, and receives input signals from the detector plate 134. The controller 136 may correlate the input signals from the detector 104 with a defined substance or compound in accordance with a look-up table or other means known in the art and provide a read-out or display.

The controller 136 may provide voltages to the electrodes 108, 110, 112 and 128 in accordance with the following table.

TABLE I

| Electrode | Voltage (V) |
|---|---|
| 108 | 6.0 |
| 110 | 3.5 |
| 112 | −16 |
| 128 | 2.5 |
| 124 | 4.5 |
| 130 | −10 |

Figure 3:
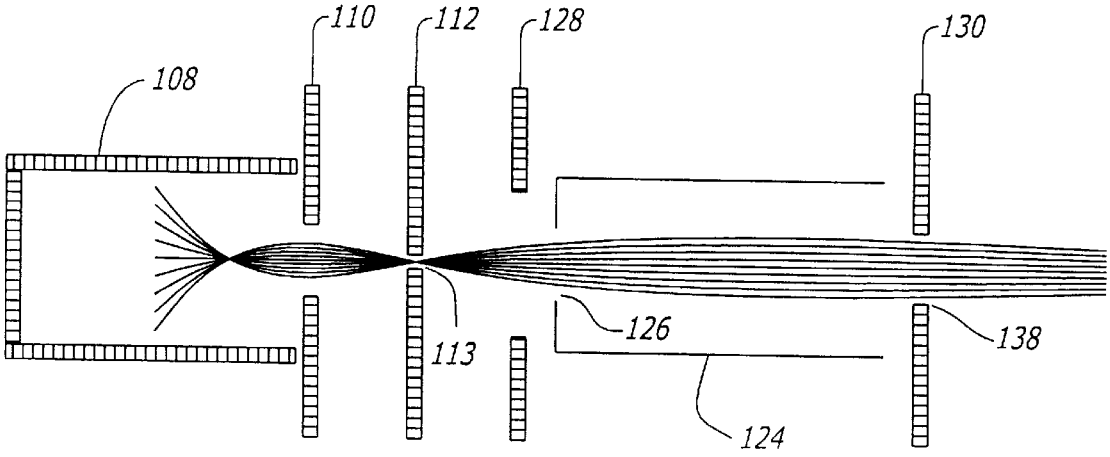
FIG. 3 is a representation showing the trajectories of ionized trace molecules moving through the mass spectrometer.

FIG. 3 shows ion trajectories from the photoionizer 102 to the detector 104 using the SIMION program. The positive voltage potentials of the electrodes 108 and 110 and the negative voltage potential of the third electrode 112 pulls the positively ionized trace molecules in the ionization chamber 118 through the apertures 113 and 126. The positive voltage potential of the electrode 128 and the anode grid cage 124 guide the ionized trace molecules to an aperture 138 in the entrance plate 130. The negative voltage potential of the entrance plate 130 pulls the ionized trace molecules into the detector 104. With the configuration shown and the voltages described, the electron-ionizer 106 provides a flexible multi-element ion lens for focusing ionized trace molecules from the photoionizer 102 to the detector 104. This embodiment provides desirable results when the ionizer is operated at a pressure of less than 0.1 torr.

The detector 104 is typically operated in a vacuum pressure of approximately 0.001 torr or less. The vacuum pressure may be created by a pump 140. The gas sample within the photoionizer 102 may be at an "atmospheric" pressure. Atmospheric pressure being defined as a pressure that is greater than 100 times the vacuum pressure of the detector 104, typically not exceeding a pressure of 10 torr, though it could operate at higher pressure. The relatively higher ionization pressure increases the density of the gas sample and the number of trace molecules that can be photoionized. The increased number of ionized molecules may improve the sensitivity of the mass spectrometer. The pressure within the ionization chamber 116 may be controlled by a pump 142. Additionally, the pressure of the chamber 116 may be controlled by the sample valve 118. When operating above 0.1 torr, it is desirable not to have a negative voltage on electrode 112 (Table I). An alternative set of voltages may be provided by controller 136 in accordance with the following table.

TABLE II

| Electrode | Voltage (V) |
|---|---|
| 108 | 12.0 |
| 110 | 10.0 |
| 112 | 5.0 |
| 128 | 4.5 |
| 124 | 4.5 |
| 130 | −10 |

The diameter of the aperture 113 defines the flow from the ionization chamber 116 to the detector 104. The flow into the mass detector should not exceed the capacity of the pump 140. The spectrometer should be designed to allow atmospheric sampling without creating a flowrate that exceeds the capacity of the detector pump. By way of example, if the ionization chamber has a volume of 1 $cm^3$ and the gas sample within the ionization chamber is approximately 1 torr, the aperture 113 may have a diameter of 0.5 millimeters (mm). Such an arrangement may produce a flowrate of approximately 0.024 torr-liter/sec. A detector pump of at least 0.024 torr-liter/sec will be able to adequately evacuate the detector. In such a configuration the residence time of the ionized trace molecules in the ionization chamber is approximately 42 milliseconds (ms). The mass spectrometer of the present invention is thus able to provide real time analysis with a photoionizer that samples at atmospheric pressure.

Figures 4A, 4B:
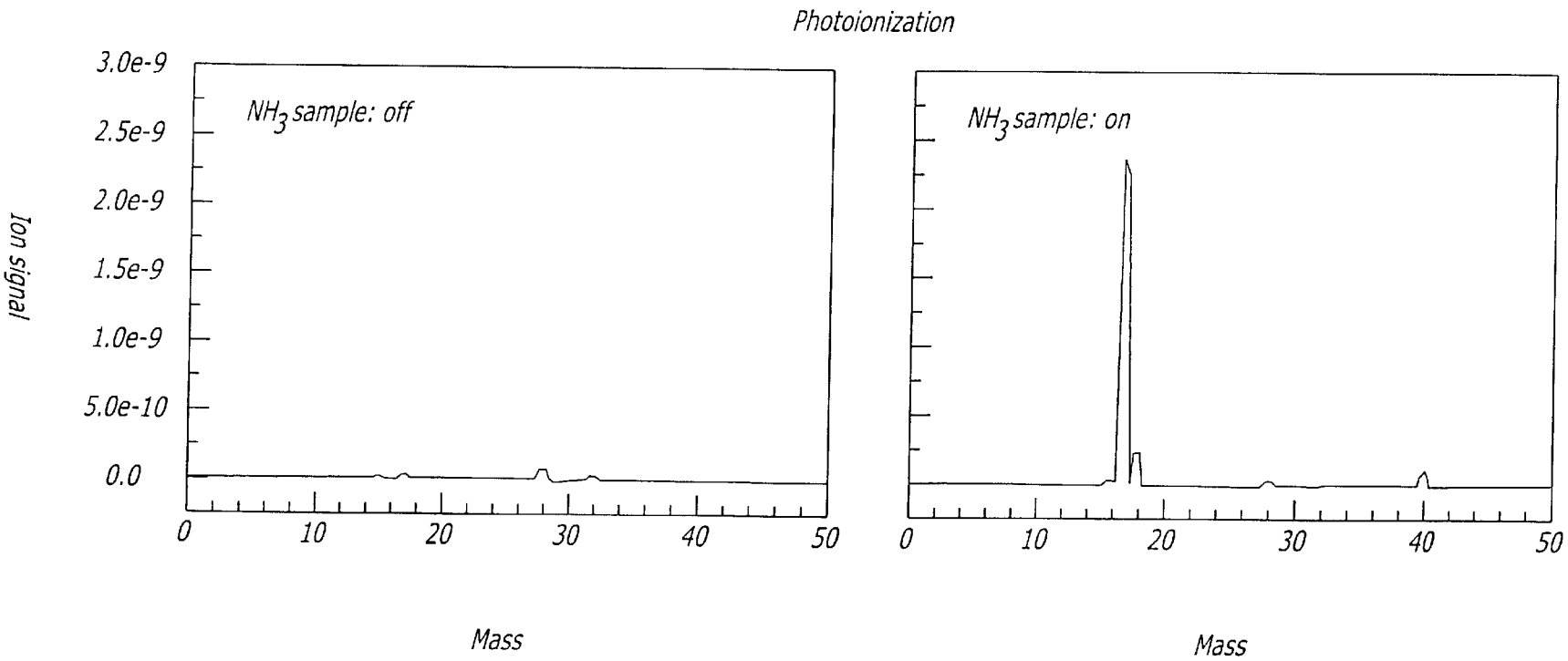
FIG. 4*a* is a graph showing the output of a mass spectrometer which utilizes photoionization, before a sample of $NH_3$ is introduced into the spectrometer.
FIG. 4*b* is a graph showing the output of a mass spectrometer which utilizes photoionization, after a sample of $NH_3$ is introduced into the spectrometer.
Figures 4C, 4D:
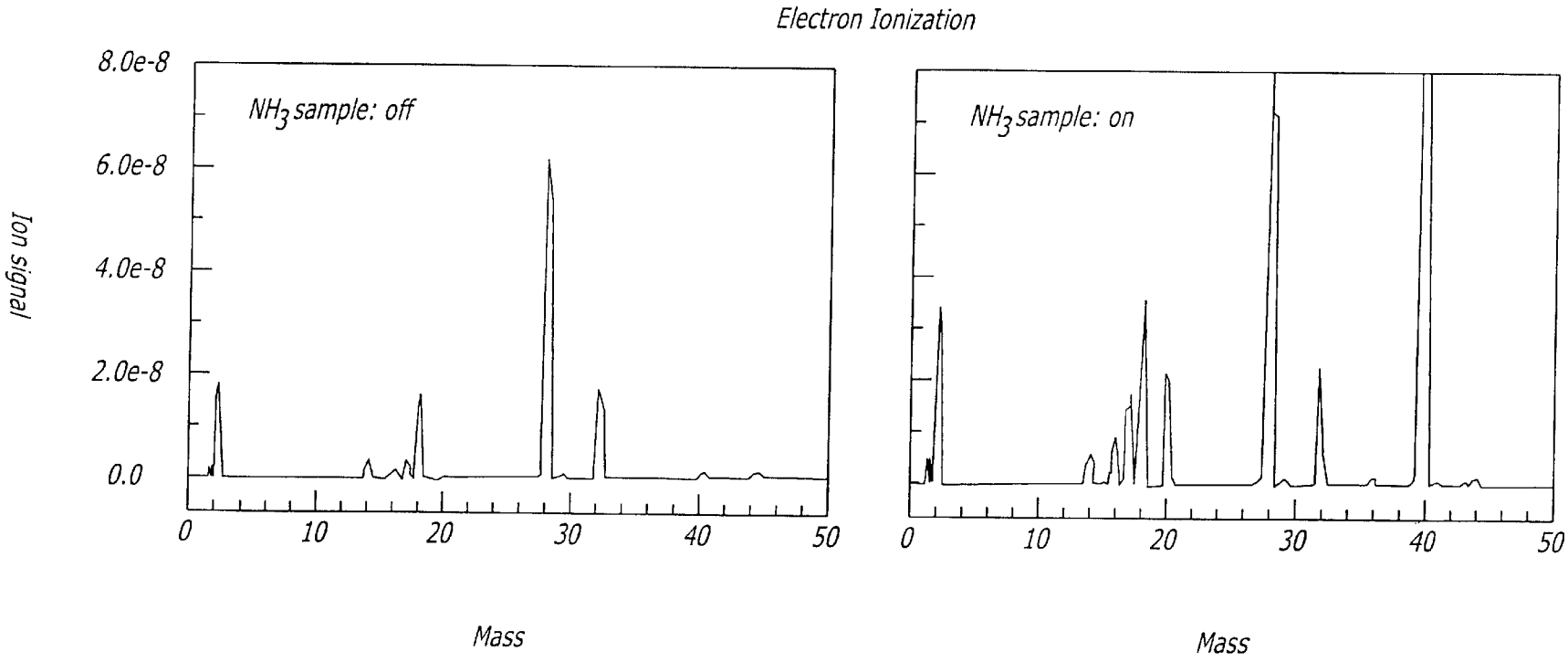
FIG. 4*c* is a graph showing the output of a mass spectrometer which utilizes electron-ionization, before a sample of $NH_3$ is introduced into the spectrometer.
FIG. 4*d* is a graph showing the output of a mass spectrometer which utilizes electron-ionization, after a sample of $NH_3$ is introduced into the spectrometer.

FIGS. 4*a–d* graphically show the advantage of ionizing with a photoionizer versus ionizing with a conventional electron-ionizer. FIGS. 4*a* and 4*b* show the output of the mass spectrometer before and after a gas sample containing $NH_3$ is introduced into the ionization chamber of a photoionizer. FIGS. 4*c* and 4*d* show the output of a mass spectrometer before and after a gas sample containing $NH_3$ is introduced into the ionization chamber of an electron-ionizer. Electron-ionization creates ionization and detection of other non-$NH_3$ molecules such as water, air, and argon the latter which is used as a carrier gas for the $NH_3$. These other ionized molecules produce additional output signals from the detector. The additional output signals can obscure the $NH_3$ signal. As shown in FIG. 4*b*, photoionization does not introduce signals corresponding to water and air making the detection of the $NH_3$ trace molecules easily discernable.

It is understood that mass spectrometers are instruments which may have a variety of uses to detect a number of different molecules. It may be that the molecules of interest are effectively ionized by both photoionization and electro-ionization. The mass spectrometer of the present invention allows an operator to photoionize and/or electron-ionize trace molecules to create multiple output signals as shown in FIG. 4*d*.

The relatively high ionization pressure of atmospheric sampling may induce ion-molecule collision that creates secondary ion products. Referring to FIG. 2, if it is undesirable to detect such secondary ion products the voltage potential of the anode grid cage 124 can be set as close as possible to the voltage potential of the second electrode 108 so that the cage repels ions created in the ionization chamber 116. The electron-ionizer 106 can thus become an ion filter.

Figure 5A:
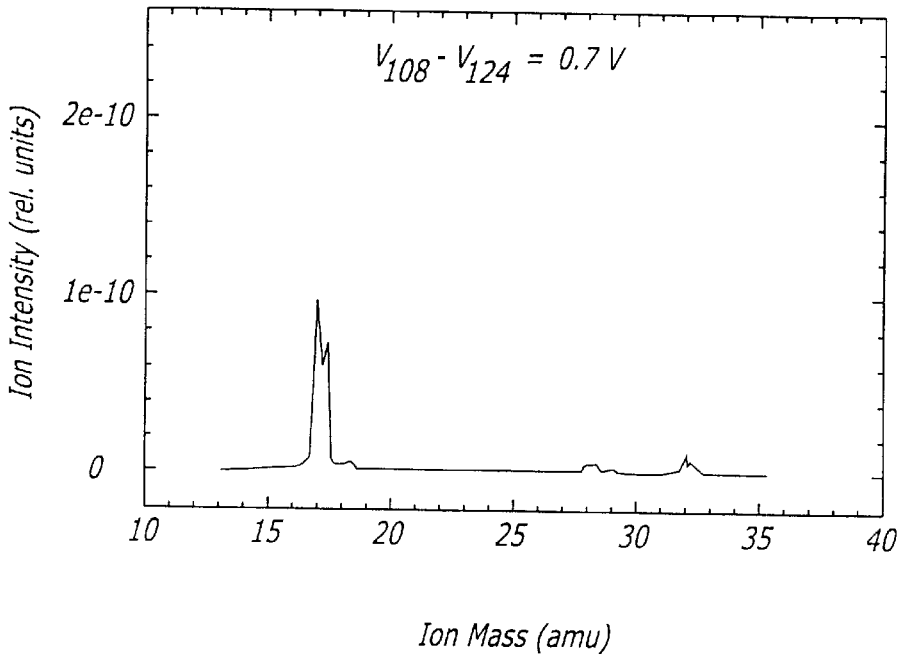
FIGS. 5*a–d* are graphs showing the output of the mass spectrometer of the present invention with different voltage potentials between an electrode of a photoionizer and an anode grid cage of an electron-ionizer.
Figure 5B:
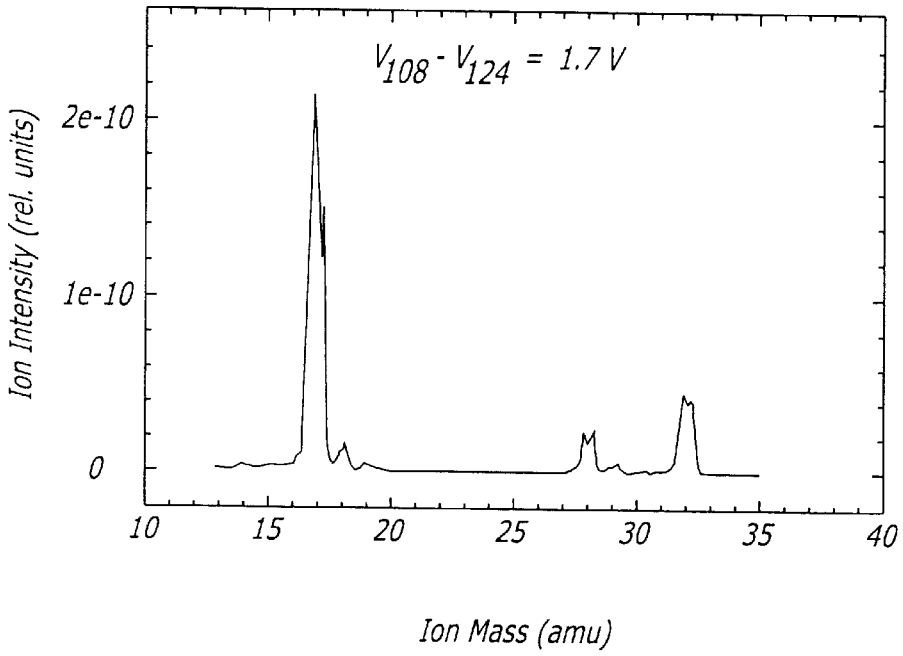
Figure 5C:
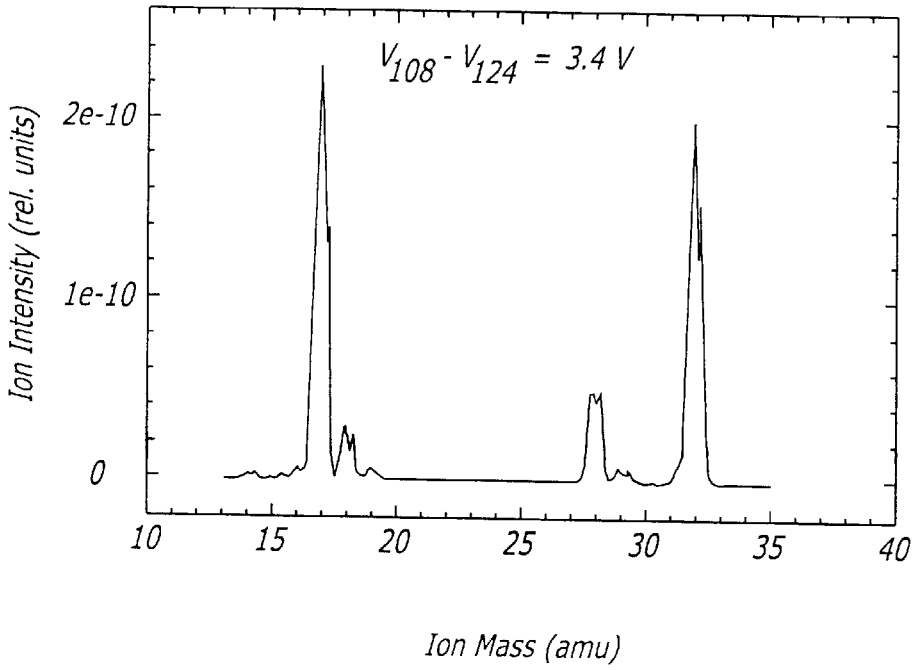
Figure 5D:
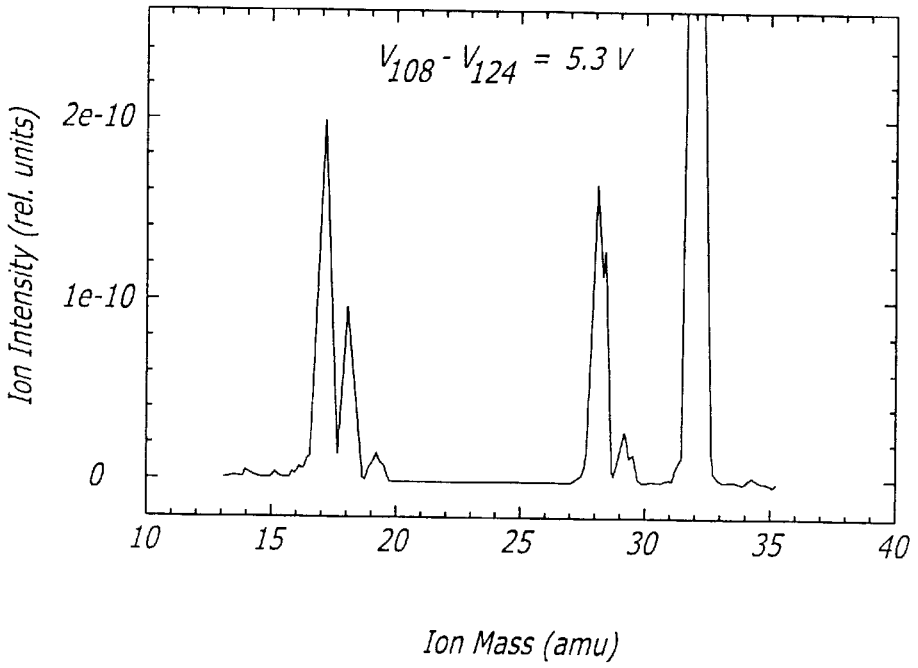

FIGS. 5*a–d* show output signals of the mass spectrometer at different voltage settings for the anode cage grid, with a gas sample that contains $NH_3$. As shown, the mass spectrometer detects less trace molecules when the anode cage voltage is set closer to the voltage of the second electrode. Increasing the anode cage voltage repels ions that may create secondary ion products as shown in FIG. 5*a*. Conversely, decreasing the anode cage voltage allows ions and the formation of secondary ion products to flow into the detector. The characteristics of the ionizer shown in FIG. 5 work best when the ionizer is operated at a pressure of less than 0.1 torr. Too many collisions in the ionizer at higher pressures may negate the effect. Some existing electron-ionization mass spectrometers do not allow for the adjustment of the anode grid cage. Adjustability can be accomplished by connecting a voltage divider circuit in series with a variable resistor to the existing voltage governing board of the mass spectrometer.

Figure 6:
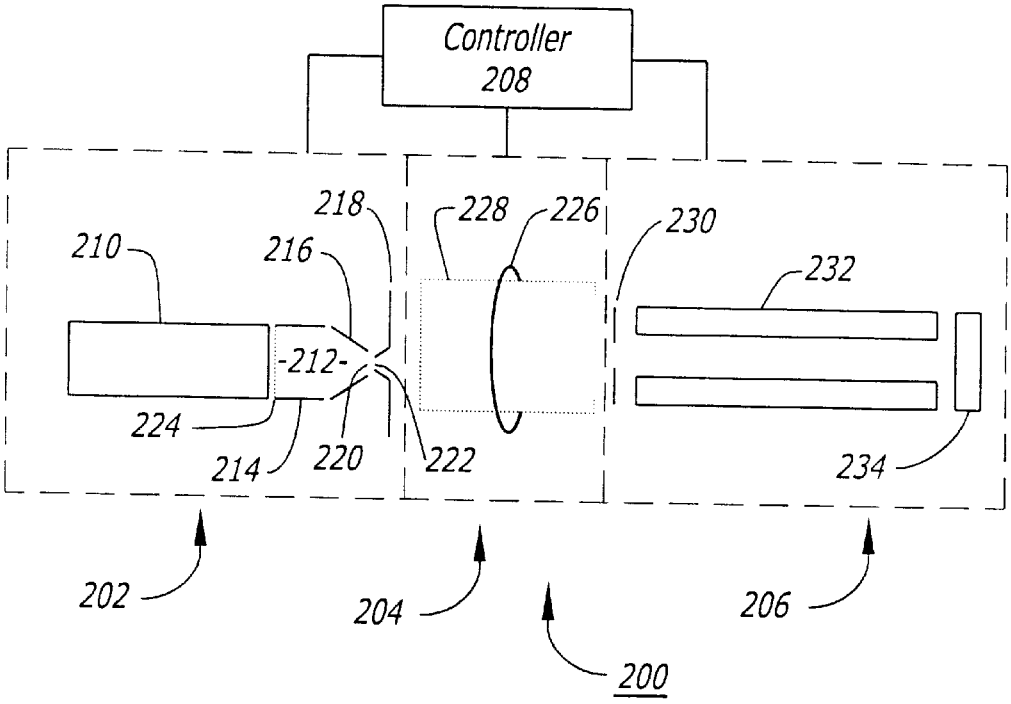
FIG. 6 is a schematic of an alternate embodiment of the mass spectrometer.

FIG. 6 shows an alternate embodiment of a mass spectrometer 200 which has a photoionizer 202, an electron-ionizer 204 and a detector 206 that are connected to a controller 208. The photoionizer 202 may include a light source 210 that can photoionize a gas sample introduced to an ionization chamber 212 by a sample valve (not shown) as discussed above. This embodiment may be more suitable for higher ionizer pressures, such as 0.1 to 10 torr.

The ionized trace molecules of the sample can be propelled into the electron-ionizer 204 by electrodes 214, 216 and 218. The electrodes 216 and 218 may have tapered openings 220 and 222, respectively, that guide the ionized trace molecule into the electron-ionizer 204. The photoionizer 202 may also include a grid 224 that is located adjacent to the light source 210. The grid 224 may achieve better field homogeneity.

The electron-ionizer 204 may have a filament 226 and anode grid cage 228 as described in the embodiment shown in FIG. 2. Additionally, the detector 206 may include an entrance plate 230, quadrupole rods 232 and a detector plate 234. The embodiment shown in FIG. 6 has one less electrode than the embodiment shown in FIG. 2, thus reducing the cost and complexity of producing the spectrometer. Additionally, the embodiment shown in FIG. 6 may have a smaller ionization chamber 212 which decreases the residence time of the ionized trace molecules and increases the speed of the mass spectrometer.

Figure 7:
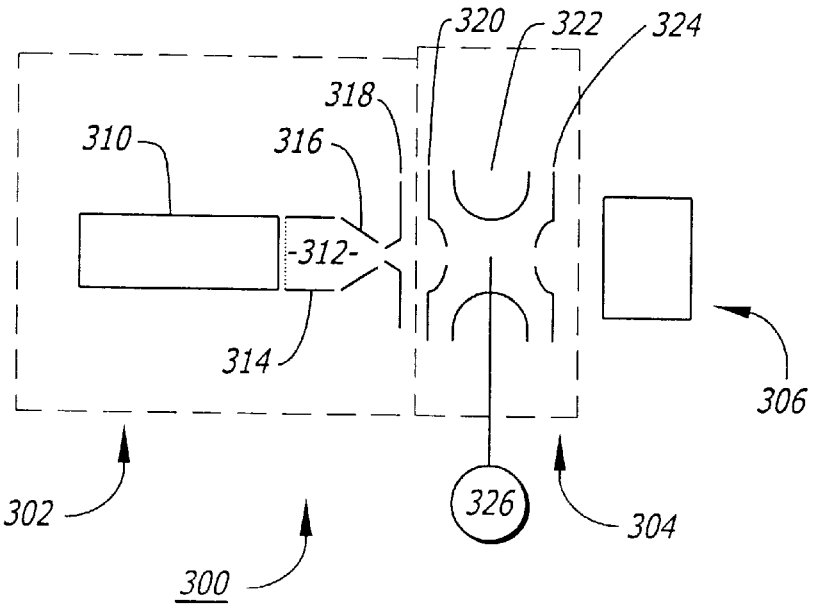
FIG. 7 is a schematic of an alternate embodiment of the mass spectrometer.

FIG. 7 shows another embodiment of a mass spectrometer 300. The mass spectrometer 300 may include a photoionizer 302 that is coupled to a quadrupole ion trap 304 and a detector 306. The photoionizer 302, quadrupole ion trap 304 and detector 306 may be controlled by a controller (not shown). The detector 306 may be a time of flight type detector. The photoionizer 302 may include a light source 310 that photoionizes trace molecules in a gas sample introduced to an ionization chamber 312 by a sample valve (not shown). The photoionizer 302 may operate at atmospheric pressure defined above as being at least 100 times the pressure of the detector pressure to increase the yield of ionized trace molecules. The electrodes 314, 316 and 318 may propel the ionized sample into the quadrupole ion trap 304. The photoionizer 302 may also have a grid 319. Alternatively other lens arrangements may be used to transfer ions from the ionizer to the quadrupole ion trap.

The quadrupole ion trap 304 may have electrodes 320, 322 and 324 that can trap the ionized trace molecules by applying an oscillating voltage to electrode 322. The quadrupole trap 304 may be coupled to a pump 326 which pulls the neutral molecules out of the trap while the electrodes retain the ionized trace molecules. The remaining ionized trace molecules can be propelled through an aperture 328 in the electrode 324 and into the detector 306 by applying appropriate voltage potentials to the electrodes 320 and 324. The quadrupole ion trap 304 and pump 326 provide a means for removing neutral molecules and reduce the capacity requirements of the pump (not shown) for the detector. As an alternate embodiment the pump 326 can be coupled to the ionization chamber to remove the neutral molecules without directly pumping the quadrupole trap.

Figure 8:
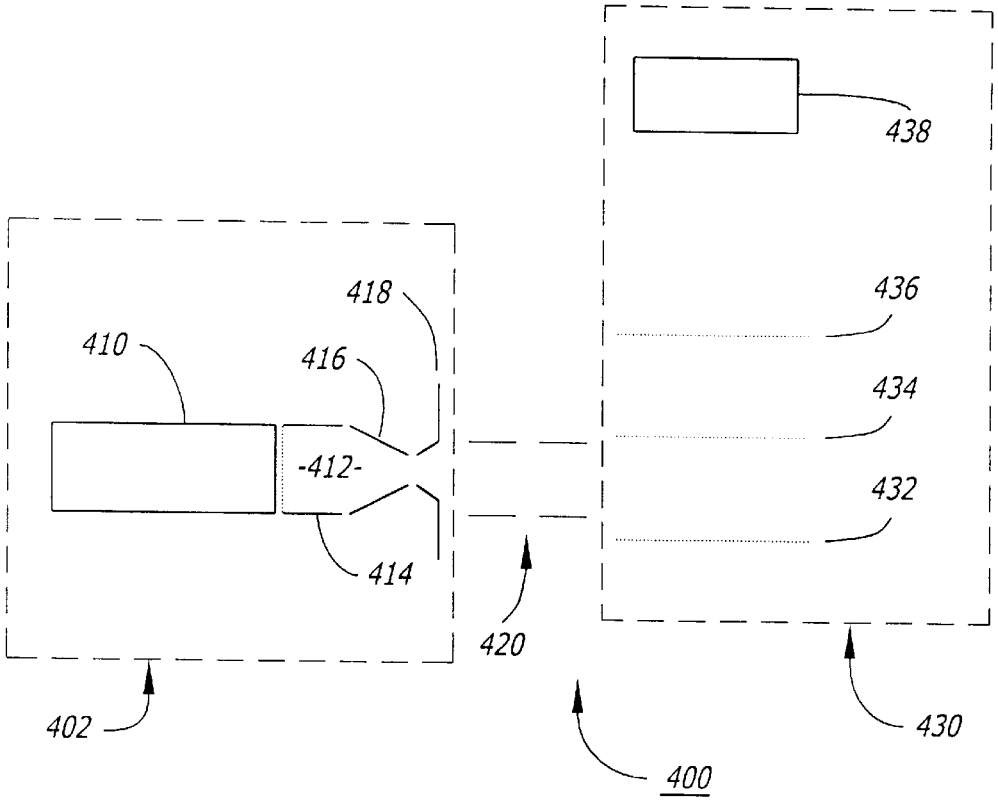
FIG. 8 is a schematic of an alternate embodiment of the mass spectrometer.

FIG. 8 shows another embodiment of a mass spectrometer 400. The mass spectrometer 400 may include a photoionizer 402 that is coupled to a time-of-flight mass spectrometer 430. A compound electrostatic lens 420 may help to collimate the beam of electrons from the photoionizer 402 to the time-of-flight mass spectrometer 430. A voltage pulse is applied to either or both grids 432 and 434 to accelerate the trail of ions in the extraction region in the direction of the final acceleration grid 436 and into the drift tube toward the detector 438 by methods known in the prior art.

As shown in FIG. 4*d*, the trace molecules which are to be detected may have similar weights. To differentiate between these similarly weighted molecules a chemical tag may be introduced into the ionized trace molecules. The tag may be a protonating agent which has a tendency to combine with one type of trace molecule but not another type of trace molecule. For example assume that there are ionized trace molecules $M^+_A$ and $M^+_B$. The protonating agent may combine with only the B-type trace molecules to create $MH^+_B$. The ionized molecules $MH^+_B$ and $M^+_A$ are detected by the spectrometer. The mass spectrometer can provide an intensity ratio $MH_{30\ B}$ to $M^+_B$ to obtain information about the content of the gas sample. The protonating agent can be introduced through the sample valve or any other means. Other selective reagents may be used to react by means other than protonation.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art. For example, the voltages in Tables I and II are merely exemplary, it is to be understood that other voltages may be employed.

What is claimed is:

1. A method for ionizing a first trace molecule in a gas sample that has a second trace molecule, wherein the first and second trace molecules have a similar weight, ionizing a first trace molecule and a second trace molecule within a gas sample, wherein the gas sample also has a chemical tag that contains a hydrogen atom wherein the hydrogen atom combines with the ionized first trace molecule but not the second trace molecule.

2. The method of claim 1, wherein the chemical tag is a protonating agent.

3. The method of claim 1, wherein the first and second trace molecules are ionized with a photoionizer.

4. The method of claim 1, wherein the mass of the first trace molecule is detected.

5. A monitor that can detect at least one trace molecule in a gas sample, comprising:

an ionization chamber;

a photoionzer that can direct a light beam into said ionization chamber;

a valve that can introduce a gas sample that has a first trace molecule and a second trace molecule which have a similar weight, and a chemical tag that contains a hydrogen atom wherein the hydrogen atom combines with the first trace molecule but not the second trace molecule; and, a detector that can detect the first trace molecule.

6. The monitor of claim 5, further comprising an electron-ionizer that is coupled to said photoionizer and said detector.

7. The monitor of claim 6, wherein said electron-ionizer directs the first trace molecule from said ionization chamber to said detector.

8. The monitor of claim 5, wherein said ionization chamber has a pressure that is at least 100 times greater than a pressure of said detector.

9. The monitor of claim 5, further comprising a quadrupole ion trap that is coupled to said ionization chamber.

10. The monitor of claim 5, wherein said detector includes a time of flight analyzer.

* * * * *